US005080230A

United States Patent [19]

Winnard

[11] Patent Number: 5,080,230

[45] Date of Patent: Jan. 14, 1992

[54] MAGNETIC SOCKET HOLDING AND STORAGE APPARATUS

[76] Inventor: Stanley D. Winnard, 3620 Pleasant Run, Irving, Tex. 75062

[21] Appl. No.: 579,160

[22] Filed: Sep. 7, 1990

[51] Int. Cl.[5] ..... B65D 85/20

[52] U.S. Cl. ..... 206/350; 206/378; 206/818; 211/70.6; 211/DIG. 1

[58] Field of Search ..... 206/376, 377, 378, 818, 206/350, 562, 564; 211/70.6, 74, DIG. 1; 248/206.5; 335/285

[56] References Cited

U.S. PATENT DOCUMENTS

| | | | |
|---|---|---|---|
| 2,217,514 | 10/1940 | Henry | 335/285 |
| 2,457,421 | 12/1948 | Warren | 211/DIG. 1 X |
| 2,527,482 | 10/1950 | Kinzler et al. | 335/285 |
| 3,212,546 | 10/1965 | Lind | 335/285 |
| 3,405,377 | 10/1968 | Pierce | 206/378 X |
| 3,481,462 | 12/1969 | Chapel | 206/564 X |
| 3,532,221 | 10/1970 | Kaluhiokalani | 211/70.6 |
| 4,337,860 | 7/1982 | Carrigan | 206/818 X |
| 4,405,108 | 9/1983 | Muirhead | 211/70.6 X |
| 4,591,817 | 5/1986 | Miller | 335/285 |
| 4,681,219 | 7/1987 | Kitchens | 211/74 X |
| 4,711,353 | 12/1987 | Rozmestor | 206/378 |
| 4,802,580 | 2/1989 | Andersen | 206/818 X |

*Primary Examiner*—David T. Fidei
*Assistant Examiner*—Jacob K. Ackun, Jr.
*Attorney, Agent, or Firm*—Arthur F. Zobal

[57] ABSTRACT

A device for magnetically securing socket wrench heads. The device includes a body member having a plurality of bores therethrough for receiving socket wrench heads. A flexible cover member is attached to the lower surface of said body member. The cover member is formed from non-metallic binding material having magnetic particles embedded therein. The socket wrench heads may be disposed within the bores and are magnetically attracted to the magnetic material of the cover member thereby maintaining said socket wrench heads within said bores. The cover member also supports the body member when placed against a metallic surface. The cover member also facilitates the one-handed removal and replacement of socket wrench heads from the device.

8 Claims, 2 Drawing Sheets

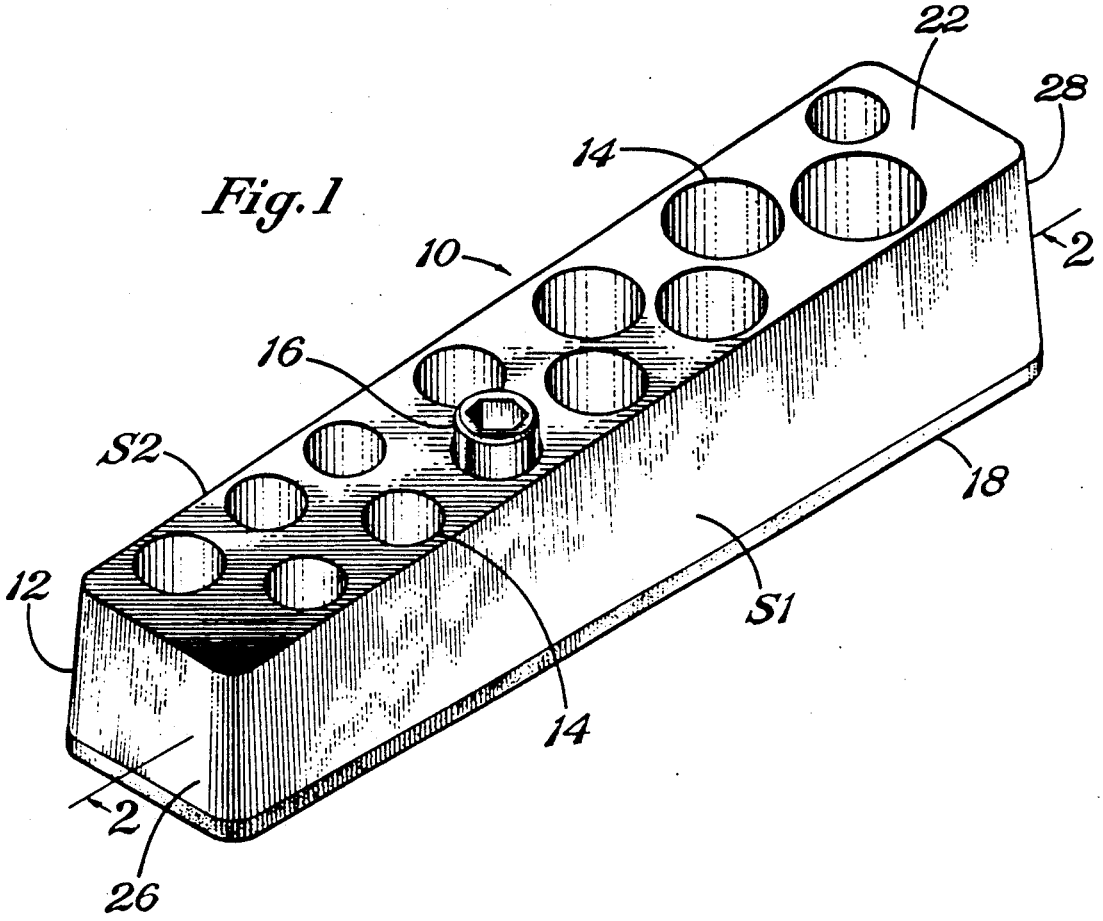
Fig. 1
Fig. 2
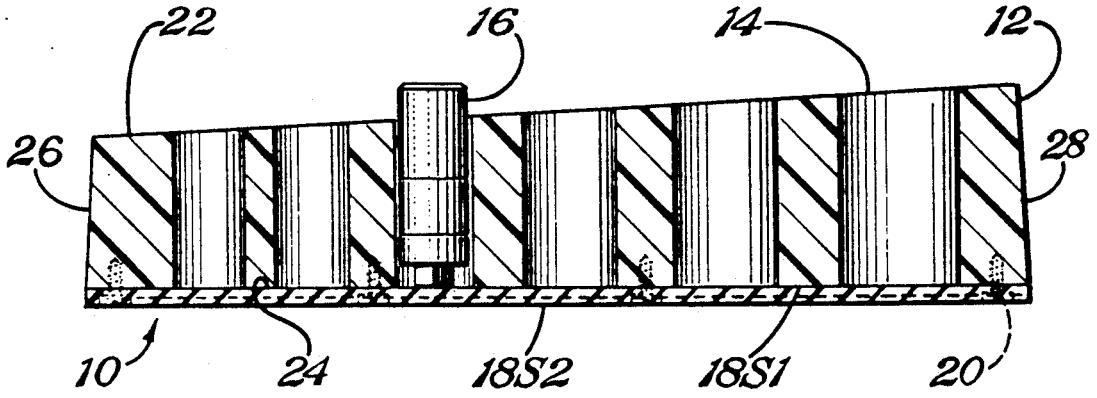

MAGNETIC SOCKET HOLDING AND STORAGE APPARATUS

BACKGROUND OF THE INVENTION

1. Field of the Invention

The present invention relates generally to the storage and/or organization of small hand tools, and more particularly provides unique holding and storage apparatus for socket sets comprising a series of different sized sockets which may be removably connected to a socket driving element, such as a pneumatic impact wrench, air ratchet, spinner, T-handle or extension, to tighten and loosen a variety of threaded fasteners having multi-sided head portions.

2. Description of the Prior Art

The typical removable socket used with a socket driving element to drive threaded fasteners is of a generally cylindrical configuration and has a square "drive" opening extending axially into one end thereof and adapted to nonrotatably receive a correspondingly configured square portion of the wrench's driving element (such as a ratchet drive member). Extending axially into the opposite end of the socket is a multi-sided fastener head or "socket" opening, usually of a hexagonal or twelve-sided configuration, to nonrotatably receive the multi-sided head of a threaded fastener.

As is well known by both amateur and professional mechanics, efficient organization of the individual sockets in sets thereof, and the rapid retrieval of a particular socket in the set, are goals that are not always easily achieved. A common method of storing socket sets is to simply keep them in a suitable drawer in a tool box. What often happens is that when a particular socket has been used, it is simply dropped back into the drawer in a random fashion so that over time the sockets become intermixed with other sockets of their particular set or with the sockets of other sets.

To solve this often annoying storage and organization problem, a variety of socket and organizational devices have heretofore been proposed. A common scheme, as exemplified in U.S. Pat. Nos. 4,043,453; 4,353,465 and 4,421,230, and German Patent 949,040, has been the provision of a series of small spring clips, each of the same size, which are fixedly or removably connected to a suitable base member and project outwardly therefrom. Each of these spring clips is configured for insertion in the drive end opening of a socket in a set thereof. When inserted into the drive end opening of a particular socket, the clip is slightly deformed so that it frictionally engages the interior surface of the drive opening to thereby retain the socket on the clip. While this type of a socket holder is clearly an improvement upon the loose-in-a-drawer socket storage approach, it is still subject to a variety of well known problems and limitations. For example, each of the spring clips is adapted to fit only one size of socket drive opening—i.e., ¼", ⅜" or ½" square (or their metric equivalents)—the standard drive opening sizes of conventional sockets. This socket-holding limitation of the spring clips does not present a problem if all of the mechanic's sockets are of the single drive size. However, if two or more socket sets have different drive sizes, this necessitates the use of spring clips of different sizes.

Additionally, since these spring clips are designed for insertion into only the drive ends of any of the sockets, the sockets can be arranged on the spring clip array in any one of a variety of arrangements. This means that the spring clips cannot function to automatically arrange the sockets in ascending or descending size order. Further, to ascertain that all of the sockets in a given set thereof have been returned to their storage clips, it is often necessary to actually count the sockets and then inspect the sockets to determine which are missing if the count comes up short.

Another problem associated with the use of the spring clip socket holders is that they can readily become deformed in use so that they fit either too tightly or too loosely within the drive end opening of a particular socket. If the spring clip becomes too loose, its socket can easily become dislodged therefrom the misplaced within the tool box or somewhere else. If the spring clip has been deformed so that it fits too tightly within the drive end opening, it becomes difficult to attach and remove the socket from the clip. Attempts to adjust the dimensions of the clips to solve these fit problems often lead to the breakage of the clips. Moreover, if a socket is pulled off a clip which fits too tightly, other sockets can be easily jarred from their clips and fall in disarray to the ground or within the tool box or other storage area.

A similar storage theme is evidenced in U.S. Pat. Nos. 1,712,473 and 3,726,393 in which identically dimensioned, rectangularly cross-sectioned post members are positioned for insertion into the identically configured square drive end openings of sockets in a set thereof. As in the case of the spring clips, these equal sized rectangular support members cannot function to automatically organize the sockets in a set thereof in any particular order. Accordingly, except by actually counting the sockets supported on these rectangular members, it is difficult to ascertain if a socket is missing from the set, and if so, which particular socket is missing. These problems are also present in the detachable wrench set organizer and storage unit disclosed in U.S. Pat. No. 4,337,860 in which equal sized cylindrical posts are used for insertion into the drive end openings of a socket set. As in the case of the square cross-sectioned posts, only sockets of a single drive size may be used with a particular set of such circular cylindrical support post members.

These organizational deficiencies are somewhat alleviated by devices, as exemplified in U.S. Pat. Nos. 4,174,037 and 4,621,738 as well as British Patent 697,995, which provide a base member having a series of projections or depressions formed therein which correspond either to the drive ends of the sockets or to the outer diameters of the drive ends of the sockets in a set thereof. These projections or depressions are adapted to closely receive the drive ends of the sockets to keep them from wobbling within the holder. The device exemplified in U.S. Pat. No. 4,621,738 has a complicated and cumbersome means for maintaining the socket wrench heads in contact with the projections. It is well known that the outer diameter of the drive end of a socket of a particular size varies (often widely) from manufacturer to manufacturer. Thus, the circular depressions in this particular support the organization system, to efficiently function as intended, would have to be custom-dimensioned to each manufacturer's socket set.

These organizational deficiencies are somewhat further alleviated by devices, as exemplified in U.S. Pat. No. 3,405,377 which provides a holder for socket wrench heads having permanent magnets embedded in the body member of the holder to maintain the wrench heads within sockets in the body member. The magnets extend to an outer surface of the body member so that they may be placed against a metallic surface so as to support the body member and the inserted wrench heads. The device disclosed in U.S. Pat. No. 3,405,377, however, would scratch or otherwise damage the metallic surface it is placed on such as the exterior painted portion of an automobile body. This patent also discloses a single magnetic strip embedded at the bottom of the holder which apparently extends to the bottom and hence has the same scratching problem as the individual magnets.

U.S. Pat. No. 4,482,049 also discloses a single magnetic strip attached to the side of a tool holding device which is of a complicated structure resulting in costly molds for manufacturing purposes.

Therefore, there is a need in the art for a simple and inexpensive device which is able to maintain a set of socket wrench heads in proper order and most importantly intact and all in one place. In addition, there is a need in the art for a device which may be releasably attached to a metallic work piece to facilitate the selection of socket wrench heads. There is also a need in the art for a device which can satisfy these above two needs while at the same time not scratching or otherwise damaging the work piece such as the exterior painted body of an automobile.

It can be seen from the foregoing that a need exists for a socket holding and organizing apparatus which eliminates or minimizes the above-mentioned and other problems and limitations commonly associated with conventional socket set holders. Accordingly, it is an object of the present invention to provide such an apparatus.

SUMMARY OF THE INVENTION

In carrying out the principles of the present invention, in accordance with the preferred embodiment thereof, apparatus is provided for supporting, an automatically organizing in a predetermined arrangement, a series of different sized sockets. Importantly, the apparatus uniquely functions to support and automatically arrange a series of different size sockets regardless of variations in their drive end opening sizes, their external diameters, or other configurational variations.

In a preferred form thereof, the present invention is directed to a magnetic socket holding and storage apparatus comprising a body member of a elongated configuration having a plurality of longitudinally spaced bores of various diameters disposed therein each of said bores extending through the apparatus from an upper surface to a lower surface of said body member, and a flexible cover member comprising non-metallic bending material having magnetic material embedded therein, attached to said lower surface of said body member, said cover member covering said lower surface of said body member at least to the extent the bore openings are covered.

The magnetic material of the cover member attached to the lower surface of the body member magnetically attracts socket wrench heads disposed within the bores of the body member. The magnetic attraction between the magnetic material and the socket wrench heads is sufficient to maintain the socket wrench heads within the bores of the body member at any angle of orientation of the body member.

The magnetic material of the cover member attached to the lower surface of the body member also serves to magnetically attract the device to a metallic surface when it is placed against a metallic surface. The device with socket wrench heads disposed therein may accordingly be located by a mechanic or machinist in any convenient orientation, even upside down, to provide for ready access to the socket wrench heads disposed therein.

One convenient and relatively inexpensive method of producing this cover member is to mix a suitable powdered metallic material, such as iron oxide, with liquid rubber before the molding process, and then magnetizing the metal subsequent to formation of the cover member. It is also particularly convenient and inexpensive to form the body member as a molded plastic unit.

The cover member attached to the lower surface of the body member covers the lower surface of the body member at least to the extent that the bore openings in the lower surface of the body member are covered. The cover member also covers the lower surface of the body member to a sufficient degree so that when the device is placed upon a metallic surface, the body member which may have sharp edges is not in contact with the metallic surface. This is important for auto mechanics so that the device can be located on the painted metallic surface of an automobile without scratching or otherwise damaging the paint.

The bores of the body member are dimensioned to loosely receive the socket wrench heads. It is unnecessary to provide a close frictional fit since the socket wrench heads are maintained within the bore by the cover member. The device is thus suitable for use with sockets of various manufacturers whose sockets may have different external diameters.

The device is configured to provide for one-handed changing of socket wrench heads. When the socket wrench heads are disposed in the device with the drive end up, the heads may be attached to and released from a socket wrench with one hand since the cover member with its magnetic material serves to facilitate the removal and replacement of the head within the device. The top surface of the body member of the device may be tapered to accommodate socket wrench heads having various lengths. The top surface of the body member of the device may also be tapered to facilitate the one-handed removal and replacement of the socket wrench heads by preventing an excessive length of said socket wrench heads from projecting beyond the top surface of the body member.

Because of its greatly enhanced support and organizational capability, the magnetic socket holder apparatus of the present invention provides a variety of substantial improvements over conventional apparatus utilized to support and store socket sets.

BRIEF DESCRIPTION OF THE DRAWINGS

In describing the invention, reference will be made to the accompanying drawings in which:

FIG. 1 is an isometric view of the magnetic socket holding and storage apparatus with a representative socket wrench head being operatively secured thereto;

FIG. 2 is a cross-sectional view taken through the magnetic socket holder and one of the sockets supported thereby, along line 2—2 of FIG. 1.

DETAILED DESCRIPTION OF THE PREFERRED EMBODIMENTS

Figure 3:
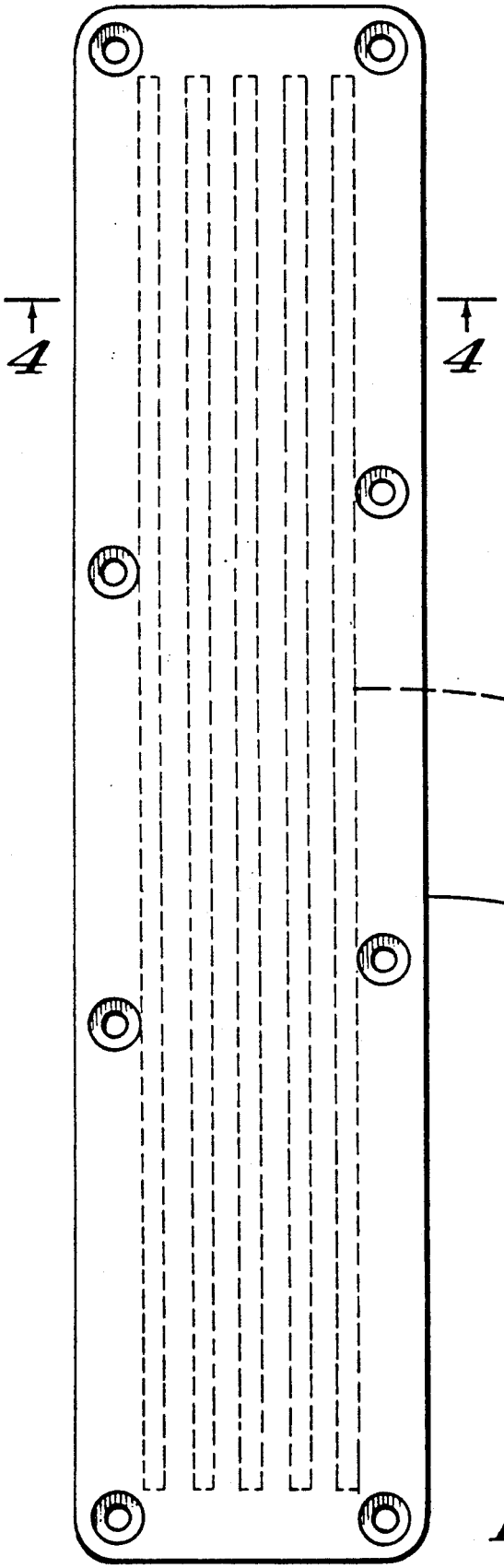
FIG. 3 is an enlarged plan view of the cover member of the apparatus of FIGS. 1 and 2, illustrating rows of magnetic particle material embedded therein.

Referring now to the drawings, a magnet socket holding and storage apparatus which embodies principles of the present invention and is utilized to magnetically support a set of socket wrench heads is generally indicated at 10. The holder 10 comprises a body member 12 of an elongated material that may be made from any suitable material. The body member 12 is preferably made from plastic material. It has upper and lower surfaces 22 and 24, parallel sides S1 and S2 and side ends 26 and 28. Surfaces 22 and 24 extend away from each other from end 26 to end 28. The body member 12 includes a plurality of circular cross-sectioned bores 14 which extend through the body member 12 from upper surface 22 to lower surface 24 of the body member 12. Each bore 14 is formed to receive a socket wrench head as generally depicted at 16, and the bores differ in diameter so that the socket wrench heads 16 may be arranged in a predetermined order within the bores 14 of the body member 12. Each bore 14 is dimensioned to loosely receive a socket wrench head 16. The body member 12, preferably, is constructed so that a socket wrench head 16 protrudes from each bore 14 a sufficient amount of provide for one-handed removal and replacement of the socket head 16 from the bore 14. The body member 12, is also preferably constructed so that bores 14 increase in length from first end 26 to second end 28 of the body member 12.

Figure 4:
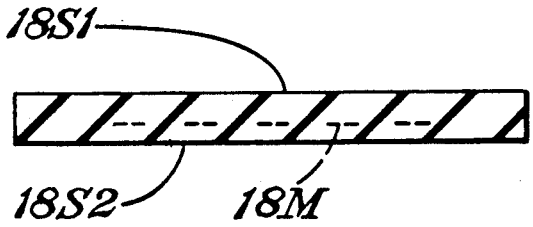
FIG. 4 is a cross-section of the member of FIG. 3 taken along lines 4—4 thereof.

A flexible cover member 18 is attached to and covers the lower surface 24 of body member 12 at least to the extent that the bore openings in the lower surface 24 of the body member 12 are covered. The cover member 18, preferably, completely covers the lower surface 24 of body member 12. In all embodiments, the cover member 18 covers the lower surface 24 to a degree sufficient to prevent the lower surface 24 form contacting a surface the device is placed upon. This configuration prevents the device from scratching or otherwise damaging the surface. The cover member 18 in one embodiment is preferably a flexible strip material formed from non-metallic binding material with magnetic material embedded therein available from Bunting Magnetic Co., Elkgrove Village, Ill. An especially preferred type of flexible strip material available from Bunting Magnetic Co. is Type W which has equal magnetic holding strength on both sides of the material. Alternatively, a suitable powdered metallic material such as iron oxide, can be mixed with rubber while it is in liquid form. In a conventional manner, this metallic material can be magnetized subsequent to the molding of the material. Referring to FIGS. 3 and 4, the cover member 18 comprises a NITRILE Rubber Binder having embedded therein strips or rows of magnetic particles 18M spaced inward from sides 18S1 and 18S2. This material is commercially available from 3M Corporation. The cover member 18 may have six strips 18M per inch of width. In one embodiment, the cover member 18 is rectangular shaped on all six sides thereof. It has a length of about 8½ inches, a width of about 2 inches and a thickness of about 3/16 of an inch.

The cover member 18 may be attached to said body member 12 by any suitable attaching means. The cover member 18 is preferably removably attached to said body member 12 such as with screws 20 as depicted in FIG. 2. Screws 20 are preferably plastic screws for easy replacement. Alternatively the cover member 18 may be permanently bonded to said body member 12.

As noted above, the cover member 18 covers the openings of bores 14 in lower surface 24. Accordingly, a portion of the cover member 18 is disposed beneath each bore 14 to hold socket wrench heads 16 within bores 14. The cover member 18 moreover, may be placed against a metallic surface so as to support the body member 12 thereon. Inasmuch as the cover member 18 is a non-metallic binding material, the device will not scratch or otherwise damage the metallic surface upon which the device is placed.

It can be seen from the foregoing that the present invention provides substantially improved apparatus for magnetically holding and organizing the individual sockets in a set thereof. The body member 12 is readily and inexpensively molded with the bores 14 extending therethrough between surfaces 22 and 24. In one embodiment, side 26 may have a height of about 1¼ inches and side 28 may have a height of ⅞ inches. Because of the unique provision of the cover member beneath each socket bore, a wide variety of individual sockets of the same nominal size may be supported in a given body member. The unique cover member which serves to maintain the socket wrench heads within the body member and secures the body member to a metallic surface and facilitate the one-handed removal and replacement of the socket wrench heads, uniquely facilitates the utilization of a socket set especially when in an awkward position in which one-handed operation is essential. Also, because the socket wrench heads are loosely received within the bores of the holder, variations in the drive end openings, the outer diameter, the length or other configurational variances in the sockets are of simply no consequence. Accordingly, compared to traditional drive-end connections of the sockets to holder supporting members such as traditional spring clips or the like, the flexibility of the improved apparatus of the present invention is significantly enhanced.

While the present invention has been described in detail and with reference to specific examples thereof, it will be apparent to one skilled in the art that various changes and modifications can be made therein without departing from the spirit and scope thereof.

I claim:

1. Apparatus for magnetically holding a series of socket wrench heads of different sizes, comprising:

a non-metallic body member having a plurality of spaced apart bores extending from a first side thereof completely through said body member to a second side thereof, and a flexible cover member separate from said body member attached to said second side of said body member covering the openings of said bores at said second side, said cover member comprising non-metallic binding material having magnetic material embedded therein, for holding metallic socket wrench heads in said bores and for use for attaching said apparatus to a metallic surface.

2. The apparatus of claim 1, wherein:

said body member has first and second ends joined by said first and second sides, said first and second sides extend away from each other from said first end toward said second end, said bores increase in length from said first end to said second end.

3. The apparatus of claim 1, wherein:

said cover member has first and second sides with said first side of said cover member attached to said second side of said body member, said second side of said cover member being free of magnetic material.

4. The apparatus of claim 2, wherein:

said cover member has first and second sides with said first side of said cover member attached to said second side of said body member, said second side of said cover member being free of magnetic material.

5. The apparatus of claim 1, wherein, said bores have different cross-sectional sizes.

6. The apparatus of claim 2, wherein:

said bores have different cross-sectional sizes.

7. The apparatus of claim 3, wherein:

said bores have different cross-sectional sizes.

8. The apparatus of claim 4, wherein:

said bores have different cross-sectional sizes.

* * * * *